United States Patent [19]

Grüger

[11] 4,424,052

[45] Jan. 3, 1984

[54] DRIVE SYSTEM FOR BLADES FOR FOLDING FLAT MATERIAL

[75] Inventor: Christian Grüger, Bennewitz, German Democratic Rep.

[73] Assignee: Veb Polygraph Leipzig Kombinat Fuer Polygraphische Maschinen und Ausruestungen, Leipzig, German Democratic Rep.

[21] Appl. No.: 374,601

[22] Filed: Apr. 30, 1982

Related U.S. Application Data

[63] Continuation of Ser. No. 157,631, Jun. 6, 1980, abandoned, which is a continuation-in-part of Ser. No. 48,355, Jun. 14, 1979, abandoned.

[30] Foreign Application Priority Data

Jun. 22, 1978 [DD] German Democratic Rep. ... 206202

[51] Int. Cl.[3] ..... B65H 45/18

[52] U.S. Cl. ..... 493/444; 493/445

[58] Field of Search ..... 493/444–445, 493/434–435; 403/58; 64/17, 22

[56] References Cited

U.S. PATENT DOCUMENTS

| | | | |
|---|---|---|---|
| 2,330,977 | 10/1943 | Johnson | 493/444 X |
| 2,423,028 | 6/1947 | Horton | 270/5 |
| 3,632,104 | 1/1972 | Dufour | 493/444 |
| 3,802,278 | 4/1974 | Loomans | 64/17 X |
| 3,995,850 | 12/1976 | Hertrich | 493/444 |

FOREIGN PATENT DOCUMENTS

| | | | |
|---|---|---|---|
| 51105 | 10/1966 | German Democratic Rep. | 493/189 |

*Primary Examiner*—A. J. Heinz

*Attorney, Agent, or Firm*—Michael J. Striker

[57] ABSTRACT

The invention is a drive system for folding blades for the folding of flat material, preferably paper, in folding devices working by the principle of blade folding, consisting of one or several universal joints interposed between the drive and output shafts of the folding-blade drive. Universal joints may be used so that the shafts are in different planes and the angle of intersection of the shafts is greater than zero. The irregularity of the angular velocity achieved will cause an extreme displacement of the point of return, so that the folding blade will contact the sheet with a small velocity and will then be considerably accelerated to reach the velocity of the folding rollers prevailing at the moment of transferring the sheet to be folded to the folding rollers. The drive and output shafts may also be telescopic shafts.

7 Claims, 7 Drawing Figures

FIG 1
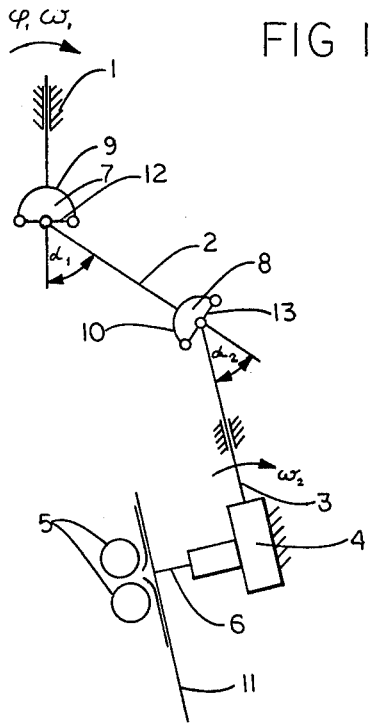
FIG 2
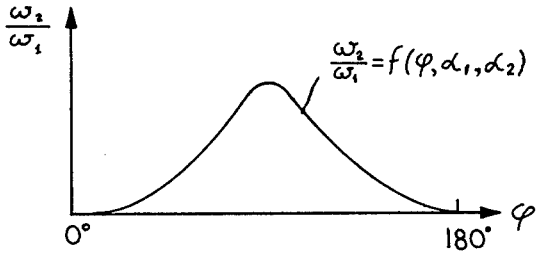
FIG 3
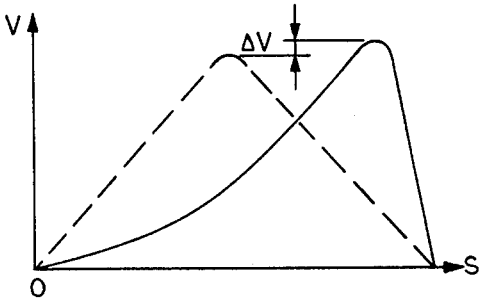
FIG 4
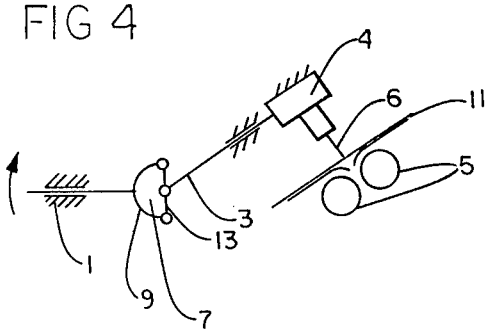
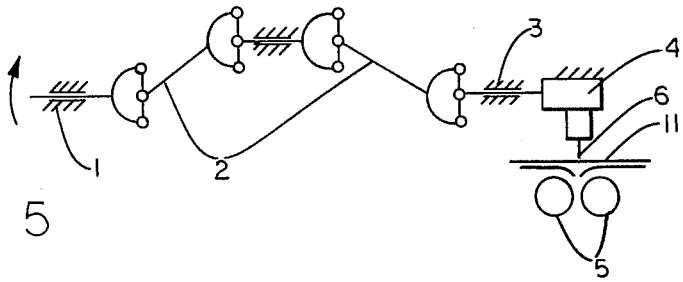
FIG 5

DRIVE SYSTEM FOR BLADES FOR FOLDING FLAT MATERIAL

CROSS-REFERENCE TO RELATED APPLICATIONS

This is a continuation of the application Ser. No. 157,631 filed June 6, 1980 and now abandoned, which in turn is a continuation-in-part of application Ser. No. 48,355, filed June 14, 1979, also abandoned.

BACKGROUND OF THE INVENTION

The invention relates to a drive system for folding blades for the folding of flat material, preferably paper, in folding devices working by the principle of blade folding.

Various drive systems are used for the operation of folding blades in blade-folding machines. As an ideal type of drive, ensuring a high quality fold, a drive system should be considered by which an irregular, infinitely variable, sequence of blade motions could be achieved. This irregular sequence of motion should be of such a type that the folding blade will slowly come into contact with the product to be folded, and will then accelerate in such a manner that at the point of transferring the folding product to the subsequent folding rollers, the momentary velocity of the folding blades will correspond to the circumferential velocity of the folding rollers. By this, a slip-free transfer of the folding product to the folding rollers would be made possible, and a high-quality fold achieved.

As German Economic Pat. No. 93 596 discloses, drives for folding blades are known in which a slider-crank linkage is so arranged in front of an antiparallel linkage that their drive crank is simultaneously the drive crank for the slider-crank linkage. Although with this solution, a more secure guiding of folding product in the direction of the folding rollers is achieved when compared to the solutions hitherto known, great difficulties exist regarding the adjustment of the depth of the inserting strode of the folding balde. With this solution, there remain also disadvantages of relatively large space requirements for installing the folding blade drive, the hign manufacturing expenditure in producing the drive, and the function per se predicating hign manufacturing precision.

In transmission technology, the use of universal joints in sequential arrangement is known. In the relevant literature, a "correct installation" and an "incorrect installation" of the universal joints are spoken of, wherein "correct installation" is taken to mean that the yokes of the intermediate shaft are located in one plane and regular rotation of the drive shaft is being reached thereby. An "incorrect installation" of the universal joints connotes the yokes of the intermediate shaft being offset at 90° to each other.

The irregular rotation of the output shaft resulting therefrom, corresponds to an irregular motional sequence in which during one complete rotation of the output shaft, maximal and minimal angular velocity will occur twice. This advantage has been utilized as per German Letters Patent No. 51 105 for the drive of rotating sealing blades in machines producing bags from foils. In these cases, the yokes of the universal joints are arranged on the telescopic intermediate shaft with a 90° offset, with the intermediate shaft on the output side connected to a set of bevel gears, and the latter in turn being arranged movably on a splined shaft. A further set of bevel gears in fixed attachment on the splined shaft effects the output onto an output shaft carrying the sealing blades. By sliding the first-named bevel gear on the splined shaft, the angle of motion can be adjusted from 0° to 45°, resulting here in a constant angular velocity at 0° and an angular velocity of variable magnitude at $\alpha > 0°$. This action of such "incorrectly installed" universal joints is relatively little known and has hitherto not been applied in technology of folding machines or in the drive of a folding blade with linear motion.

SUMMARY OF THE INVENTION

The objective of the invention consists in creating a folding-blade drive with which a slip-free transfer of the folding product to the folding rollers can be achieved and with a relatively simple design resulting in less costly construction.

From the above, the task consists of developing a folding-blade drive with which transfer of the folding product to the folding rollers could be made as far as possible without any differential in velocity and in which the adjusting of the depth of the inserting stroke of the folding blade can be made relatively simple, with the entire construction also to be of a design with no large expenditure as to the method of manufacture. As per the invention, one or several universal joints, and at least one universal shaft, are to be interposed between the drive shaft and the output shaft of a folding blade drive. When using universal shafts, it is important that the two yokes of the universal shaft are located in different planes and/or that the angle of intersection is greater than zero. Arranging the yokes in two different planes will result in an additional superimposing onto the irregularity of the angular velocity as transmitted by the universal joints. This irregular rotary motion will cause an extreme displacement of the point of return in the travel-time sequence of the folding blade. It is utilized to have the blade contact the folding sheet at a low speed and then to accelerate in such a manner that at the moment of transfer of the folding sheet from the folding blade to the folding roller or other devices, the momentary velocity will approximately correspond to the circumferential velocity of the folding rollers. Thus, a slip-free transfer of the sheet to be folded from the folding blade to the folding rollers is made possible, and a precondition created for the attainment of an improved quality of the fold.

Moving of the point of return can be adjusted by varying in an infinite manner the angle of intersection $\alpha$. For this purpose, the drive shaft and/or the output shaft are designed to allow changing of their position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 shows a folding-blade drive with two interposed universal joints;

FIG. 2 is a graphic representation of the principle of the transmitting function of a universal joint as per FIG. 1;

FIG. 3 is a graphic comparison of the velocity-travel characteristics of the two slider crank drives, one without universal joints (broken line) and one with universal joints set before it (solid line);

FIG. 4 shows a folding-blade drive with one interposed universal joint;

FIG. 5 shows a folding-blade drive with four interposed universal joints;

DESCRIPTION OF THE PREFERRED EMBODIMENTS

Figure 6:
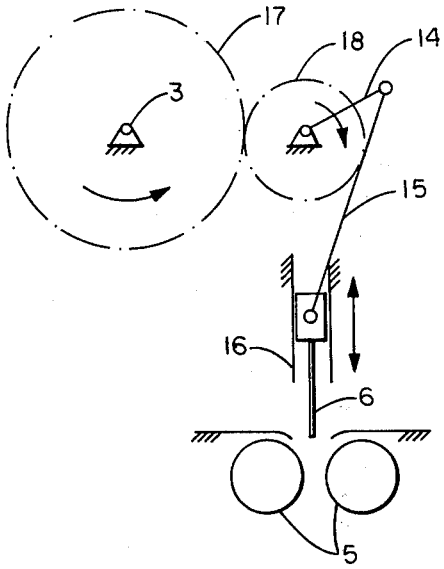
FIG. 6 is a more detailed view of the transmission linkage of FIGS. 1, 4, 5.

In FIG. 1, the drive shaft is connected by the universal joint 7 having a yoke 9 to the universal shaft 2, forming an angle of intersection $\alpha_1$. The same universal-joint arrangement is present in the transition from the universal shaft 2 to the output shaft 3 utilizing the universal joint 8 having a yoke 10, so that both shafts form the angle of intersection. Arranging the yokes of the universal shaft 2 in different planes will result not in the cancelling of the irregularity occurring at the output member of an universal joint, but in the increasing of it. By this irregularity, the peak value of the angular velocity is reached twice during one revolution of the output shaft 3. A transmission 4 with the ratio 1:2 is therefore subsequently arranged. The folding blade 6 is actuated from the output shaft 3 over a transmission 4. Herein, the phase of the maximal angular velocity of the output shaft 3 can be so located that it will effect the folding blade 6 in every instance when the latter has reached its lowest point between the folding rollers 5. Thus the sheet 11 to be folded will be imparted with approximately the same velocity as the circumferential velocity of the folding blades 6. This approximation of the velocity enables a slip-free transfer of the sheet 11, from the folding blades 6 to the folding rollers 5, and thus a fold of better quality is produced.

As can be noted in FIG. 2, the irregular motion causes the maximum velocity to be attained twice per revolution. FIG. 2 displays the value of the transmitting function of the output as a function of the angle of rotation $\gamma$ and of the two angles of intersection $\alpha_1$, $\alpha_2$.

FIGS. 1, 4 and 5 show different embodiments of the invention with FIG. 4 exhibiting the simplest construction of a single joint having an angle of about 60°. This arrangement produces much wear and tear so the arrangements of FIGS. 1 and 5 show more advantageous embodiments using multiple joints which eliminate the problem.

In FIG. 6, transmission 4 is exhibited in greater detail. The drive shaft 3 has its rotary motion converted into linear motion which drives folding blades 6 by a system of gears. Gear 17 is attached to drive shaft 3 and engages gear 18 to which is connected a rotary drive member 14 that acts through a coupling 15 to produce the linear motion of folding blade 6 with the assistance of guide 16 which restricts the motion of folding blade 6 to complete linearity. A favorable gear ratio for gear 17 and gear 18 is 1:2.

In the velocity-travel diagram of FIG. 3, two curves in apposition will be the respective velocity-travel ratio of two slider-crank drives, one of which works with universal joints arranged before it, and the other without universal joints arranged before it. The advantages of the irregular velocity resulting from the universal joints can be clearly noticed in the solid curve. A continually rising rate of increase in velocity, $v_{mx}$ is followed in the shortest possible way by a drop to $v=0$.

By the small continual rise in velocity, more time is available for the feed of the sheet 11 to be folded, which is an essential contribution to steadying the sheet and fixing it in its location immediately prior to the folding sequence.

In the FIGS. 4 and 5, further arrangements of drive systems for folding blade drives are shown, into which universal joints were inserted and with which optimal sequencing of the motions were achieved.

Figure 7:
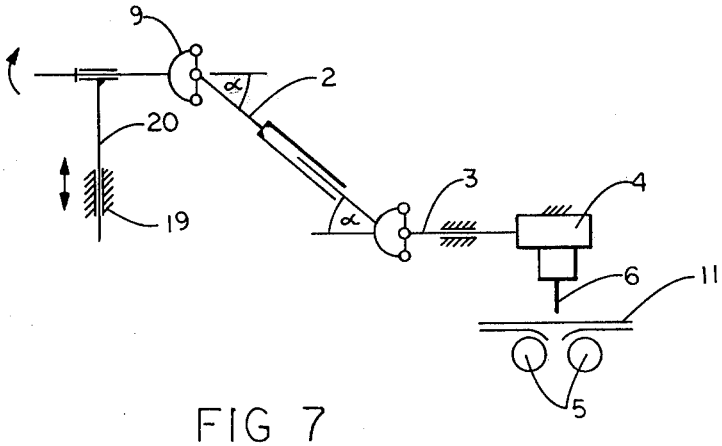
FIG. 7 shows a folding-blade drive with two universal joints and guide members.

In FIG. 7 another variation is shown wherein a guide 19 orients a guide member 20. The drive shaft 2 with universal joint is allowed to move relative to drive shaft 3. By altering the relative orientations of drive shaft 2 with respect to output shaft 3 the gear ratio of the system is easily changed. This change in the relative position of the shafts is facilitated by forming at least one of the shafts as a telescopic shaft. This variation of the gear ratio increases the system capability for dealing with formats of varying size, i.e. large formats require relatively few strokes and thus involve less inertial forces due to the change of the blade direction at the turning point permitting a high gear ratio and increased precision, whereas small formats necessitate larger numbers of reciprocating motions leading to high inertial forces which must be partially compensated through smaller gear ratios. Thus, the change in gear ratio is advantageous for solving this problem, and the use of a longitudinally variable shaft which permits a continuous change is especially useful.

It will be understood that each of the elements described above, or two or more together, may also find a useful application in other types of constructions differing from the types described above.

While the invention has been illustrated and described as embodied in a drive system for folding blades for folding of flat material it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A drive system for folding blades for folding flat material, particularly paper, comprising rotary drive means having a drive shaft and a universal shaft; transmission means cooperating with a folding blade and operatively connected to said universal shaft, said transmission means being adapted to convert rotary motion of said drive means into linear motion and to impart said linear motion to said folding blade; said drive means further including an output shaft connected to said transmission means, a first universal joint having a yoke and interconnected between said drive shaft and said universal shaft, the yoke of said universal joint and said drive shaft extending in different planes which intersect one another forming an angle of intersection, a second universal joint having a second yoke and interconnected between said universal shaft and said output shaft, the yoke of said first universal joint and the yoke of said second universal joint extending in different planes, which intersect one another forming an angle of intersection; means orienting said first and second universal joints to produce an irregular angular velocity during a single revolution of said drive shaft, whereby said irregular angular velocity is transmitted to said folding blade via said transmission means to produce variations in the folding action of said folding blade; and means connected to said drive shaft and operative for changing a relative position of said drive shaft to said output shaft.

2. The drive system of claim 1, wherein an angle of intersection of said drive shaft with said universal shaft differs from an angle of intersection of said universal shaft with said output shaft.

3. The drive system of claim 2, wherein said drive shaft and said output shaft extend in the same plane.

4. The drive system of claim 1, wherein an angle of intersection of said drive shaft with said universal shaft is equal to an angle of intersection of said universal shaft with said output shaft.

5. The drive system of claim 4, wherein said drive shaft and said output shaft extend in the same plane.

6. The drive system of claim 1, wherein at least one of said shafts is formed as a telescopic shaft.

7. A drive system for folding blades for folding flat material, particularly paper, comprising rotary drive means having a drive shaft; two rotationally interconnected universal joints; and transmission means operative for converting a rotary motion of said drive means into linear motion which is transmitted to a folding blade, said drive shaft being connected to the two interconnected universal joints; means for orienting said universal joints and shafts to produce an irregular angular velocity during a single revolution of said drive shaft, whereby said irregular angular velocity is transmitted to said folding blade via said transmission means to produce variations in the folding action of said folding blade.

* * * * *